US005814147A

United States Patent [19]

Tallard

[11] Patent Number: 5,814,147

[45] Date of Patent: Sep. 29, 1998

[54] METHOD FOR STRENGTHENING AND IMPROVING CLAY SOILS

[75] Inventor: Gilbert Tallard, New York, N.Y.

[73] Assignee: Envirotrench Company, Pelham, N.Y.

[21] Appl. No.: 784,549

[22] Filed: Jan. 21, 1997

[51] Int. Cl.[6] ..... E02D 3/12

[52] U.S. Cl. ..... 106/900; 405/263; 405/264; 405/266; 405/267

[58] Field of Search ..... 405/266, 267, 405/128, 129, 263, 264; 166/293; 106/900

[56] References Cited

U.S. PATENT DOCUMENTS

| | | | |
|---|---|---|---|
| 3,097,492 | 7/1963 | Salassi | 405/266 |
| 3,687,200 | 8/1972 | Routson | 405/264 |
| 3,875,751 | 4/1975 | Paus | 405/263 |
| 4,064,940 | 12/1977 | Sparlin | 405/263 |
| 4,212,565 | 7/1980 | Watabe | 405/269 |
| 4,393,939 | 7/1983 | Smith et al. | 106/718 |
| 4,566,825 | 1/1986 | Hirai et al. | 405/267 |
| 4,606,675 | 8/1986 | Mitani et al. | 405/263 |
| 4,637,759 | 1/1987 | Owa et al. | 106/900 |
| 4,886,400 | 12/1989 | Taki et al. | 405/267 |
| 4,886,550 | 12/1989 | Alexander | 106/706 |
| 4,906,142 | 3/1990 | Taki et al. | 405/267 |
| 4,958,962 | 9/1990 | Schellhorn | 405/267 |
| 5,026,215 | 6/1991 | Clarke | 106/714 |
| 5,106,423 | 4/1992 | Clarke | 106/714 |
| 5,141,366 | 8/1992 | Ishida et al. | 405/266 |
| 5,263,797 | 11/1993 | Lindstrom et al. | 106/900 |
| 5,269,632 | 12/1993 | Pelletier et al. | 106/607 |
| 5,295,769 | 3/1994 | Sano | 405/266 |
| 5,325,922 | 7/1994 | Cowan et al. | 166/293 |
| 5,368,415 | 11/1994 | Kono et al. | 405/267 |
| 5,378,085 | 1/1995 | Kono et al. | 405/267 |
| 5,417,522 | 8/1995 | Kono et al. | 405/266 |
| 5,447,197 | 9/1995 | Rae et al. | 166/293 |
| 5,476,142 | 12/1995 | Kajita | 106/803 |
| 5,488,991 | 2/1996 | Cowan et al. | 166/293 |
| 5,503,501 | 4/1996 | Kunito | 405/241 |
| 5,512,096 | 4/1996 | Krause | 106/718 |

FOREIGN PATENT DOCUMENTS

| | | | |
|---|---|---|---|
| 5202516 | 8/1993 | Japan . | |
| 2170839 | 8/1986 | United Kingdom | 106/900 |

*Primary Examiner*—Paul Marcantoni
*Attorney, Agent, or Firm*—Larson & Taylor

[57] ABSTRACT

A method of strengthening and improving the load-bearing capacity of soft clay-containing subterranean soil comprising advancing a soil processing tool into said subterranean soil to break said soil into discrete particles; while advancing said soil processing tool into said soil, introducing an aqueous composition consisting essentially of water and a clay dispersant in an amount sufficient to disperse said discrete particles and make water from said clay available for hydration of subsequently added cement; when the soil processing tool has reached its desired depth, withdrawing same and simultaneously adding during said withdrawal a cementitious composition comprising water and a cement in a water-to-cement weight ratio of 0.4 to 1:1 and in an amount which provides a weight ratio of the total water of said aqueous dispersant containing composition, said clay soil and said cementitious composition to said cement of about 4 to 6:1; and allowing said mixture to harden.

12 Claims, 1 Drawing Sheet

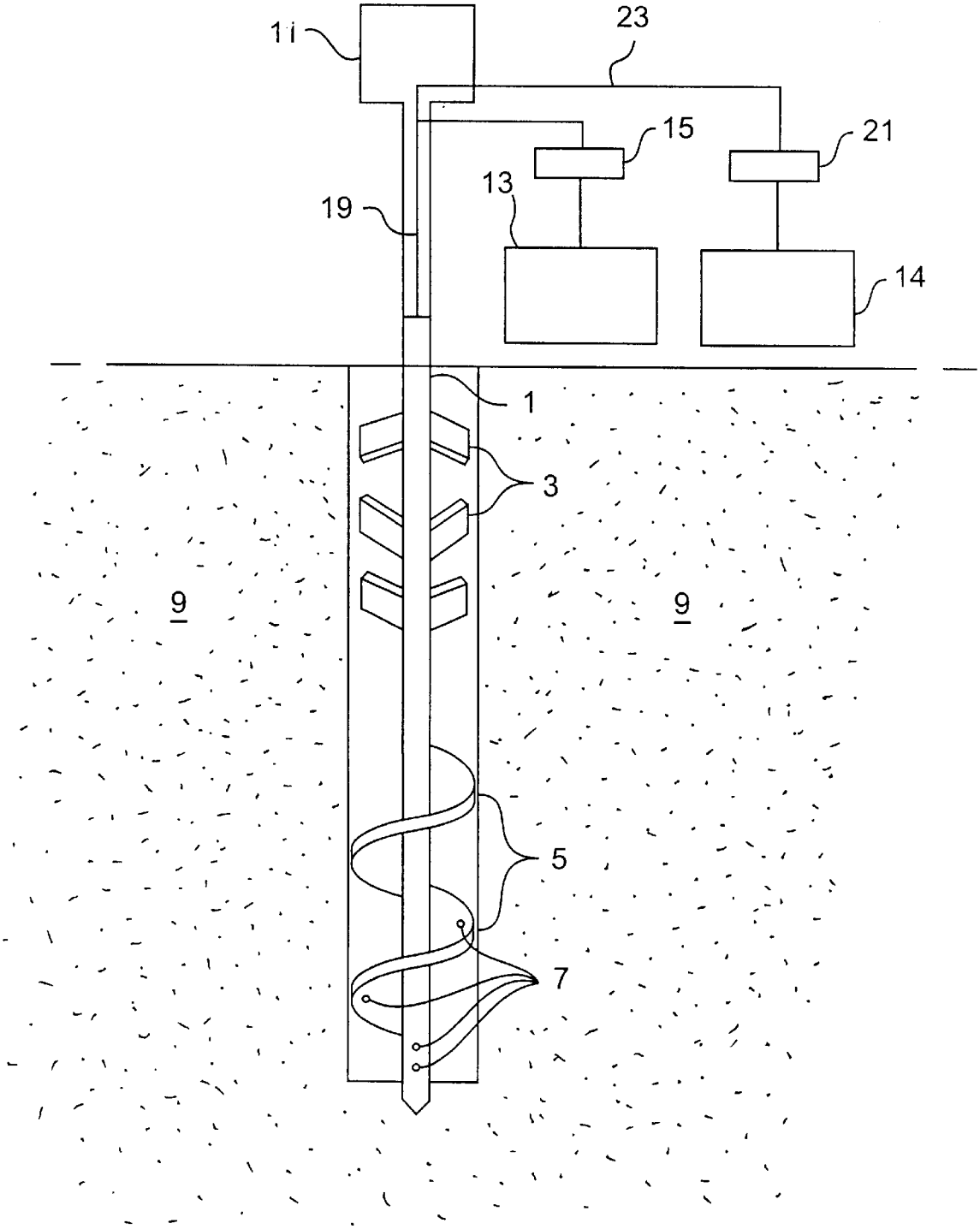
11
23
15
21
13
19
14
1
3
9
9
5
7

METHOD FOR STRENGTHENING AND IMPROVING CLAY SOILS

BACKGROUND OF THE INVENTION

The present invention relates generally to an improved method for strengthening subterranean clay soils wherein the soils are admixed with a cementitious hardener.

A variety of procedures have been developed for strengthening the integrity of soft soils through the use of cementitious binders. The general procedure in all of these methods involves breaking down the soil texture using a soil processing tool such as a modified soil auger and mixing the resulting granulated soil with a cementitious binder. This technique has many applications, from improving ground characteristics or solidifying sludges to supporting excavations. Like all cementitious binders, the material's ultimate strength will vary with the total water/cement ratio and the total amount of cement per weight of soil. Inherent to this technology is the fact that in order to break down the soil's texture, it is necessary to form spaces between the grains wherein the binding grout may dwell. The addition of grout typically takes place while drilling/mixing down to desired depth, and while retrieving the auger in a continuous mixing process. This results in significant waste, constituted of both soil and grout, coming to the surface, which waste needs to be carted away. This represents a substantial cost element of this technique. The percentage of such waste will vary to a large extent and is a function of the type of soil involved. The percentage is less than for a clean sand than for a stiff clay, where the percentage is typically between 40% and 90% of the in situ volume. Some prior art teaches the use of single augers of a smaller diameter to pre-drill dry and to loosen the ground and extract a fraction of the soil in order to achieve greater depth subsequently with the soil mixing augers. This amounts to bringing to the surface a fraction of the soil volume to be converted into soilcrete and to cart it away as waste. The prior art also teaches the use of water or a "lubricating slurry" to facilitate the penetration of the soil mixing augers with the possibility of achieving deeper depth within the workable time allowable by the cementitious mixture.

because of their cohesiveness, higher water content than granular soils, and lower intrinsic strengths, are the most difficult soils to solidify with a high level of consistency in order to achieve the same results as with a granular soil. Typically, a substantial volume of clay has to be extracted and replaced with a cementitious mixture that may incorporate aggregates. This causes a high level of replacement and therefore a high level of waste. Because of the added moisture in the grout required to break down the clay by comparison to a granular soil, a high amount of cement is also required in order to maintain an acceptable water/cement ratio. The result is a method with substantial economic shortcomings.

It is an object of the invention to reduce both the amount of the water required to achieve the desired consistency of clay soil and the total quantity of cementitious material required to achieve a specified strength.

Another object of the invention is to substantially reduce the waste volume thereby providing a far more economical method.

SUMMARY OF THE INVENTION these and other objects of the invention are obtained by a method comprising:

advancing a soil processing tool into soft clay-containing subterranean soil to break said soil into discrete particles;

while advancing said soil processing tool into said soil, introducing an aqueous composition consisting essentially of water and a clay dispersant in an amount sufficient to disperse said discrete particles and make absorbed water from said clay available for hydration of subsequently added cement;

when the soil processing tool has reached its desired depth, withdrawing same and simultaneously adding during said withdrawal an aqueous cementitious composition comprising water and a cement in a water-to-cement weight ratio of 0.4to 1:1 and in an amount that together with the water released from said clay and said aqueous dispersant containing composition, provides a cementitious composition having a weight ratio of water to cement of about 2 to 6:1; and allowing said mixture to harden.

The present improvement attempts to reduce the amount of added water required to achieve the desirable consistency of the soil mix and to reduce commensurately the total quantity of cementitious material required to achieve a specified strength. As a consequence, the waste volume is reduced resulting in a substantial economic advantage.

The improvements in the conventional method of strengthening soils are obtained by delaying the introduction of the hardening cementitious binder (grout) until the drilling tool has reached its desired depth. During this drilling step only water and a dispersant for the clay soil are added. The aqueous cementitious composition is not introduced until the tool withdrawal phase.

Thus, the total water added in the method of the invention is split between the drilling/clay soil liquefaction phase and processing tool withdrawal phase wherein the hydraulic cement is introduced. In other words, the grout introduced contains a much lower water/cement ratio than that of the prior art methods.

This improvement is rendered possible by taking advantage of the high water content that characterizes clay soils and using this water as part of the total water of hydration for the hydraulic cement. The key to this achievement resides in obtaining the complete disintegration of the cohesive soil with much less water than is presently used with limited results in the cementitious grout employed in the prior art methods wherein it is introduced during the drilling and making the water in the clay available for hydration by adding one or more clay dispersants during the drilling/clay liquefaction stage.

By both separating the clay particles and increasing the availability of absorbed water in the clay for hydration of the cementitious binder, the chemical reaction of the particles, which are silicoaluminates, with cementitious binder is facilitated and contributes to the overall strength of the soilcrete end product.

As a result a number of advantages are obtained:

i) The waste volume created is substantially reduced thereby resulting in a saving in waste removal costs. Instead, the high water content of the clay is taken advantage of.

ii) Of the waste volume created, much less than half is mixed with the grout, hence a further reduction in wasted cement quantities is obtained.

iii) The introduction of grout into the liquified soil from the bottom up is made more efficient since the energetic part of the soil matrix breakdown process has been performed on the way down. Subsequently, a better control of the concentrated grout placement is achieved.

iv) The waste created by the displacement of the liquified clay by the grout injected from the bottom up is still pure soil waste, in other words, the cement is not yet wasted. It is only when getting toward the surface is cement grout getting somewhat mixed into the waste.

BRIEF DESCRIPTION OF THE DRAWING

In the drawing, a system for carrying out the method of the invention in a subterranean formation is schematically illustrated.

DESCRIPTION OF PREFERRED EMBODIMENT

The soil processing tool used to mechanically dig into the subterranean soil and break it up into discrete particles is a tool having at least one elongated hollow shaft and means for cutting the soil attached thereto. A plurality of injection nozzles are provided the hollow shaft through which are pumped the aqueous composition of water and dispersant and the cementitious composition during digging withdrawal, respectively. Preferably the tool is an auger having one or more hollow shafts, one or more helical flights, one or more cutting tips, and a plurality of injection nozzles.

The aqueous composition introduced during the drilling step will contain clay dispersant in an amount sufficient to disperse the clay and make the water from said clay available for hydration of subsequently added cement. Normally the concentration of dispersant falls in the aqueous composition in the range of about 2% to 20% by weight, preferably about 4% to 6% by weight. Any of the prior art dispersant known to effectively disperse clay materials can be used as, for instance, alkali metal polyacrylates such as sodium polyacrylate.

Other suitable dispersants include:

calcium lignosulfonate, sulfonated naphthalene, sodium acid pyrophosphate, sodium tannate (gallic acid), carboxylic acid amide, sodium salt of carboxylic acid polymer, and sodium silicate.

The cementitious composition introduced into the soil through the processing tool during the withdrawal of the tool comprises a hardening slurry of cementitious material and water. The cementitious material can comprise any cement-based hardener such as Portland cement or ground blast furnace slag cement (GBFSC). The latter is the preferred cement based cementitious binder since it does not exhibit a rigidification that characterizes Portland cement when first hydrated and does not contain much lime which reacts with the clay quickly. Higher strength is achieved with blast furnace slag cement than with the same amount of Portland cement since significantly less water is required to produce the same soilcrete consistency. Also, by using the GBFSC the set proper is delayed for an adjustable period of time and the waste created by overlaps and by reworking previously mixed soil is avoided thereby reducing waste and increasing savings.

The weight ratio of the water to the cement in the cementitious composition will vary depending upon the strength of the final product desired and will be that which forms a mixture. Ordinarily, the weight ratio of water to cementitious material will fall in the range of 0.4 to 1:1, preferably about 0.4 to 0.5:1.

The total amount of the hardener slurry added will vary depending upon the amount of water introduced with the aqueous dispersant plus that made available from the clay. In general, the total weight ratio of water to cementitious material will fall in the range of 2 to 6:1, preferably 4 to 6:1.

Since clay particles contain a high level of silica, as well as the GBFSC, a highly alkaline medium will facilitate the transformation of silica into colloidal form. This is the process by which dispersed clay particles can become chemically active with the cementitious binder in the elaboration of the soilcrete end products. Sodium hydroxide solutions provide economically such an alkaline environment. Sodium carbonate and sodium bicarbonate can be used as additives for improving ultimate strength and regulating setting time, respectively.

The following example is provided to further illustrate the invention.

EXAMPLE

A modified conventional auger 1, containing a combination of paddle wheels 3 and spiral flights 5 and injection nozzles 7 is used to drill into clay soil 9. An auger drive means 11 which rotates the auger into the situs at a depth of 45 feet.

During the downward drilling phase an aqueous dispersant comprised of 100 grams of water and 4 grams of sodium polyacrylate polymer as a clay dispersant is pumped from a source 13 using pump 15 and line 17 into the shaft of auger 1 and out nozzles 7. The rate of penetration is 0.5 to 3 feet/min. and the injection rate is respectively 10 to 120 gal/min.

When the auger reaches the prescribed depth, an aqueous slurry of ground blast furnace slag cement (GBFSC) at a water cement ratio by weight of 0.45 is pumped from source 14 by pump 21 through lines 23 and 19 into the shaft of auger 1 and out nozzles 7. The rate of extraction and mixing is about 3 to 8 feet/min. and the grout pumping rate is respectively 100 to 275 gal/min. Since the clay soil is liquified a much higher rotational speed of the auger is possible on the way up.

The cementitious mixture remaining in the situs after withdrawal of the auger possesses a total water-to-cement ratio 2.5:1.

Setting of the soilcrete mix can be regulated between eight hours to seventy-two hours through the use of an alkaline solution (such as caustic soda or sodium silicate) which is injected intermittently in the grout stream entering the mixing auger stem. The soilcrete will take a few months to reach its ultimate strength, 350 psi in this case.

It is claimed:

1. A method of strengthening and improving the load-bearing capacity of soft clay-containing subterranean soil and substantially reducing the waste volume by reducing the amount of water required to achieve a set consistency of the clay soil and the total quantity of cement required to achieve a specific strength comprising:

advancing a soil processing tool into soft clay-containing subterranean soil to break said soil into discrete particles;

while advancing said soil processing tool into said soil, introducing an aqueous composition consisting essentially of water and a clay dispersant in an amount sufficient to disperse said discrete particles and make absorbed water from said clay available for hydration of subsequently added cement;

when the soil processing tool has reached its set depth, withdrawing same and simultaneously adding during said withdrawal an aqueous cementitious composition comprising water and a cement in a water-to-cement weight ratio of 0.4 to 1:1 and in an amount that together with the water released from said clay and said aqueous dispersant containing composition, provides a cementitious composition having a weight ratio of water to cement of about 2 to 6:1; and allowing said mixture to harden.

2. A method according to claim 1 wherein the clay dispersant is a salt of an acrylic polymer.

3. A method according to claim 2 wherein the dispersant is an alkali metal salt of an acrylic polymer.

4. A method according to claim 3 wherein the dispersant is sodium acrylate polymer.

5. A method according to claim 1 wherein the dispersant is sulfonated naphthalene polymers.

6. A method according to claim 1 wherein the total water-to-cement ratio is about 4:1.

7. A method according to claim 1 wherein the cement is Portland cement.

8. A method according to claim 1 wherein the cement is a ground blast furnace slag cement.

9. A method according to claim 1 wherein the aqueous cementitious composition includes a water-reducing agent.

10. A method according to claim 9 wherein the water reducing agent is a sulfonated naphthalene.

11. A method according to claim 1 wherein the aqueous cementitious composition includes a caustic soda solution.

12. A method of strengthening and improving the load-bearing capacity of soft clay-containing subterranean soil and substantially reducing the waste volume by reducing the amount of water required to achieve a set consistency of the clay soil and the total quantity of cement required to achieve a specific strength comprising:

advancing a soil processing tool into said subterranean soil to break said soil into discrete particles;

while advancing said soil processing tool into said soil introducing an aqueous dispersant composition consisting essentially of water and sodium acrylate polymer in an amount that releases water from said clay soil;

when the soil processing tool has reached its set depth, withdrawing same and simultaneously adding during said withdrawal a cementitious composition comprising blast furnace slag cement, a water reducing agent and water in a water-to-cement ratio of 0.4 to 1:1 and in an amount that together with the water freed from said clay soil and the water in said aqueous dispersant composition provides an aqueous cementitious composition having a total water-to-cement weight ratio of about 4 to 1:1; and allowing the mixture to harden.

* * * * *